US011375790B2

(12) United States Patent
Skultety

(10) Patent No.: US 11,375,790 B2
(45) Date of Patent: Jul. 5, 2022

(54) DUAL LOCK WALLET

(71) Applicant: Steven M. Skultety, Middletown, CT (US)

(72) Inventor: Steven M. Skultety, Middletown, CT (US)

( * ) Notice: Subject to any disclaimer, the term of this patent is extended or adjusted under 35 U.S.C. 154(b) by 205 days.

(21) Appl. No.: 16/852,487

(22) Filed: Apr. 19, 2020

(65) Prior Publication Data

US 2020/0329838 A1 Oct. 22, 2020

Related U.S. Application Data

(60) Provisional application No. 62/836,618, filed on Apr. 20, 2019.

(51) Int. Cl.
*A45C 13/18* (2006.01)
*A45C 1/06* (2006.01)

(52) U.S. Cl.
CPC ..... *A45C 13/185* (2013.01); *A45C 1/06* (2013.01); *A45C 2001/065* (2013.01)

(58) Field of Classification Search
CPC ..... A45C 13/185
USPC ..... 206/320; 150/147
See application file for complete search history.

(56) References Cited

U.S. PATENT DOCUMENTS 2,413,580 A * 12/1946 Perry ..... F42B 39/02 206/3

* cited by examiner

*Primary Examiner* — John K Fristoe, Jr.
*Assistant Examiner* — Justin Caudill
(74) *Attorney, Agent, or Firm* — Z IP Law PLLC

(57) ABSTRACT

A wallet having first and second locking fixtures, the wallet configured to secure money, credit cards and identification with the added advantage in some embodiments that the contents are viewable within the wallet even when the first and second locking fixtures are securely closed.

11 Claims, 14 Drawing Sheets

42
22
28
L
40

R
26
44
24
46

42
28a
16a
48
36
18
44
26a
S
F

26b
F
18
S
36
28b
46
16b
50
40

DUAL LOCK WALLET

RELATED PATENT APPLICATION

This application claims the benefit of U.S. Provisional Patent Application No. 62/836,618 filed Apr. 20, 2019 entitled DUAL LOCK WALLET which is hereby incorporated herein by reference in its entirety.

FIELD OF THE INVENTION

The present invention is related to wallets, money clips and other money, credit card and identification holding devices with the added advantages of the wallet of the present invention having first and second locking fixtures and providing for the contents within the wallet to be viewable even when the first and second locking fixtures are securely closed.

BACKGROUND OF THE INVENTION

The loss of cash or a credit card can be a traumatic and embarrassing experience, but all too frequently a credit card is removed from a wallet or mistakenly left on a table or counter after paying, because an additional step of reopening and verifying the contents of a wallet is not done. Wallets of the common billfold style of the prior art require reopening to view contents because they are formed out of two long rectangular panels. The two panels are sewn together along three sides to form an opening for paper money to be slid into and pulled out of Credit cards and a driver's license or other identification cards, or other plastic currency are placed in slots formed in an interior panel or are placed in plastic sheets attached to the interior panel. The billfold is closed by folding the panels in half over one another or in thirds by folding a first end and then folding a second end over the first end. When closed the contents of the wallet are not visible, which may possibly cause a loss of for example a credit card if the credit card is removed and then not put back into the wallet, if the wallet is not reopened and verified that the credit card has been returned to the wallet. When full of cash and credit cards, the common folded or tri-folded billfold also have the added disadvantage of being thick and bulky making the wallet awkward and uncomfortable to place in a pants pocket.

Money clips offer viewing of the contents, but most work by having the clip clamp down on either side of the cash or credit cards to hold them. Over time the spring tension of the clip can wear and loosen which may allow a bill or credit card to slide out of the money clip and be lost. The rigid plastic and thickness of multiple credit cards or a lot of paper money may also loosen the clip allowing some of the contents to fall out of the clip, so while there is the benefit of the contents being viewable, the contents of the money clip is not secure. The present invention provides the flexibility of viewing cash and credit cards like a money clip with the security of a folded closed wallet that cannot easily be opened.

SUMMARY OF THE INVENTION

The dual lock wallet of the present invention is formed in a uniquely styled shape to allow the contents of the wallet to be easily accessible and viewable, and two locking fixtures to secure the contents. In the present invention two sheets of pliable, durable material such as leather or fabric are each formed with a panel, flap, and locking fixture. The locking fixture comprises a locking receiver and lock such as a socket and snap, hook and loop, hook and eye or clasp, slot and button or other types of fasteners suitable for adhering the leather or fabric sheets together. In forming the dual lock wallet of the present invention, the panels of the first and second sheets are overlaid so that the flaps extending from each panel extend in opposing directions. The first and second panels are sewn, glued, stapled or otherwise affixed together along the two remaining sides of each panel forming a compartment. The compartment has first and second access points for the placement of paper money through the first access point and into the space formed between the sides that are sewn or otherwise affixed together and through the second access point for the placement of credit cards, identification or other plastic currency also into the space within the compartment.

A receiver for the locking fixture is affixed to each panel and a compatible lock is affixed to each flap. A flap from a first panel is folded over an access point and the lock mates with and is secured to the receiver on the second panel thereby securing the contents within the compartment, for example the paper money placed within the compartment through the first access point. The flap from the second panel is folded over the second access point and the lock mates with and is secured to the receiver on the first panel to for example secure the credit cards placed within the compartment from the second access point. The contents are therefore secured at either end and can be accessed by rotating the wallet and unlocking the locking fixture to provide access to the desired contents, either the paper money from one access point or the credit cards from the other access point. Within the compartment both the paper money and credit cards are stacked and therefore each access point provides access to either top or bottom of the stack to remove paper money or credit cards from either access point.

In some embodiments, one or both of the panels are formed with cutouts within at least one corner to provide for viewing the contents of the wallet even when each of the dual locks for each access point are secured. By having a portion of the contents viewable, the wallet can be rotated to the proper access point and the locking fixture can be opened to access the contents. The at least one cutout further provides for visual inspection of the contents of the wallet when secured to determine a dollar amount or confirm that a credit card has been returned to the wallet after use without having to reopen the wallet. A finger slot may also be provided along an edge of one or both panels to allow for a thumb or finger to press against the contents and slide the paper money or credit card out of the wallet.

The present invention is related to a wallet comprising a first sheet formed as a first panel and a first flap, the first flap extending from the first panel; a first locking fixture having a first receiver affixed to the first panel and a first lock affixed to the first flap; a second sheet formed as a second panel and a second flap, the second flap extending from the second panel; a second locking fixture having a second receiver affixed to the second panel and second lock affixed to the second flap; and wherein the first receiver configured to receive the second lock to secure the first flap to the second panel thereby configured to secure a first access point of a wallet; and wherein the second receiver configured to receive the first lock to secure the second flap to the first panel thereby configured to secure a second access point of the wallet. In embodiments of the wallet, the first and second sheets are of a pliable, durable material such as leather or fabric. In embodiments of the wallet, the first sheet is configured to be aligned over the second sheet and the first and second sheets are configured to be attached together along a first edge seam and a second edge seam forming a compartment having the first access point on one end and the second access point on the other end, the compartment configured to hold money, credit cards, identification, or other plastic currency. In embodiments of the wallet, of the first and second receivers are first and second sockets and the first and second locks are snaps configured to be attached to the first and second socket receivers. In embodiments of the wallet, the first and second receivers are hook fasteners and the first and second locks are loop fasteners configured to be attached to the first and second hook receivers. In embodiments of the wallet, the first and second receivers are first and second fasteners and the first and second locks are clips configured to be attached to the first and second fastener receivers. In embodiments of the wallet, the first and second receivers are first and second hooks and the first and second locks are eye fasteners configured to be attached to the first and second hook receivers. In embodiments of the wallet, the first and/or second panels comprise cutouts in at least one of four corners, the first and second panels configured to have contents within the wallet be viewable at the points where a panel has the at least one cutout. In embodiments of the wallet, the first and/or second panels comprise a finger slot configured to assist in removing contents from within the wallet. In embodiments of the wallet, the first and second flaps comprise a triangular shape, the triangular shape configured to reduce the thickness of the wallet. In embodiments of the wallet, the first and second flaps comprise a triangular shape and a curvature forming the edges of the triangle, the curved triangular shape configured to reduce the thickness of the wallet.

These and other features, advantages and improvements according to this invention will be better understood by reference to the following detailed description and accompanying drawings. While references may be made to upper, lower, vertical and horizontal, these terms are used merely to describe the relationship of components and not to limit the installation or use of the present invention to any one orientation.

BRIEF DESCRIPTION OF THE DRAWINGS

Some embodiments of the present invention are illustrated as an example and are not limited by the figures of the accompanying drawings, in which like references may indicate similar elements and in which.

DETAILED DESCRIPTION OF THE DRAWINGS

Figure 1:
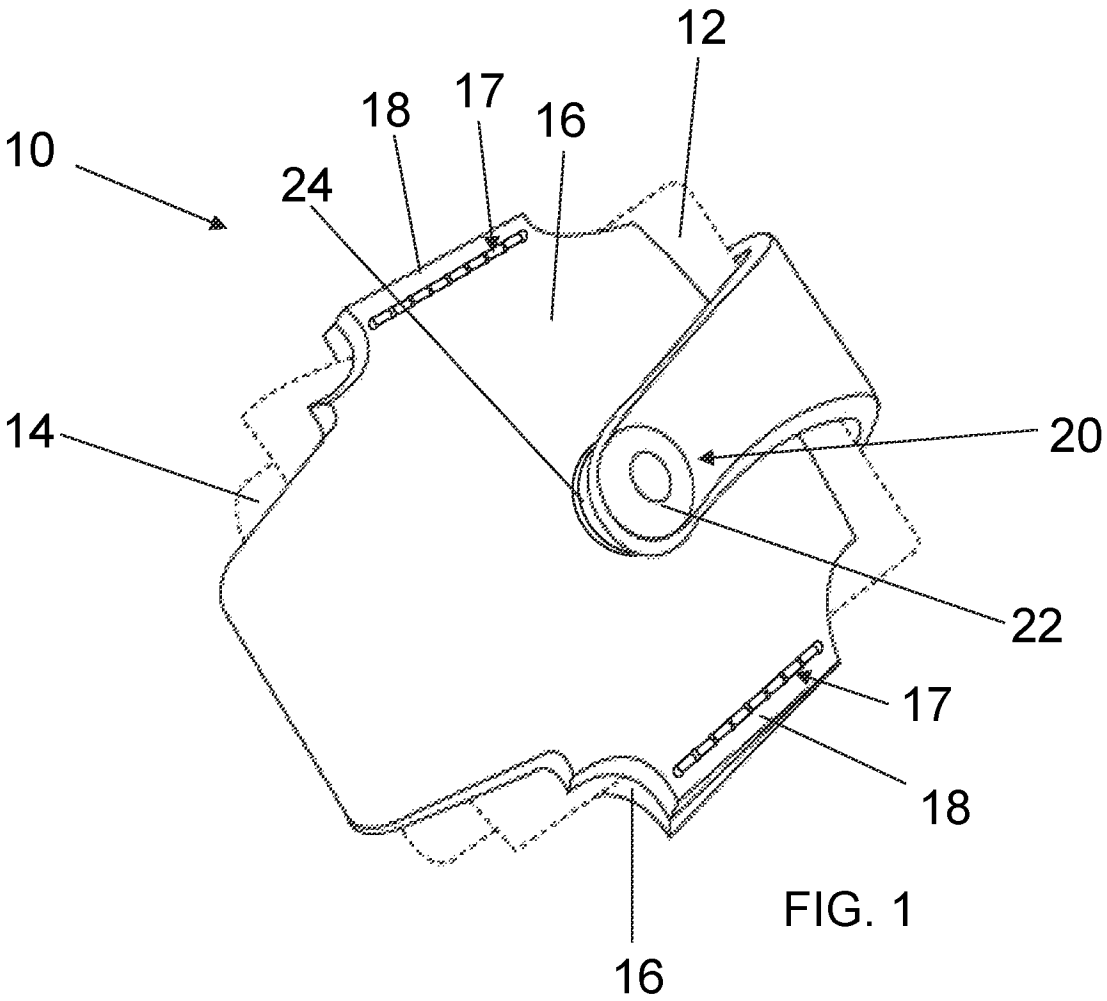
FIG. 1 is a perspective view of an embodiment of the dual lock wallet of the present invention having a snap and socket for the locking fixtures.

As shown in FIG. 1, the present invention is related to a dual lock wallet 10 for securely holding paper money 12 and credit cards 14, identification or other types of plastic currency. The dual lock wallet 10 is formed from two leather or fabric sheets 16 that in some embodiments are sewn together to form a seam 17 along the edges 18 as shown. Alternatively, the leather or fabric sheets 16 may be glued, stapled, riveted or otherwise affixed together. First and second locking fixtures 20 secure the two sheets together to secure paper money 12 and/or credit cards 14 within the wallet 10. The locking fixture 20 has a lock portion 22 and a receiver portion 24 that mate and secure the two sheets together.

Figure 2B:
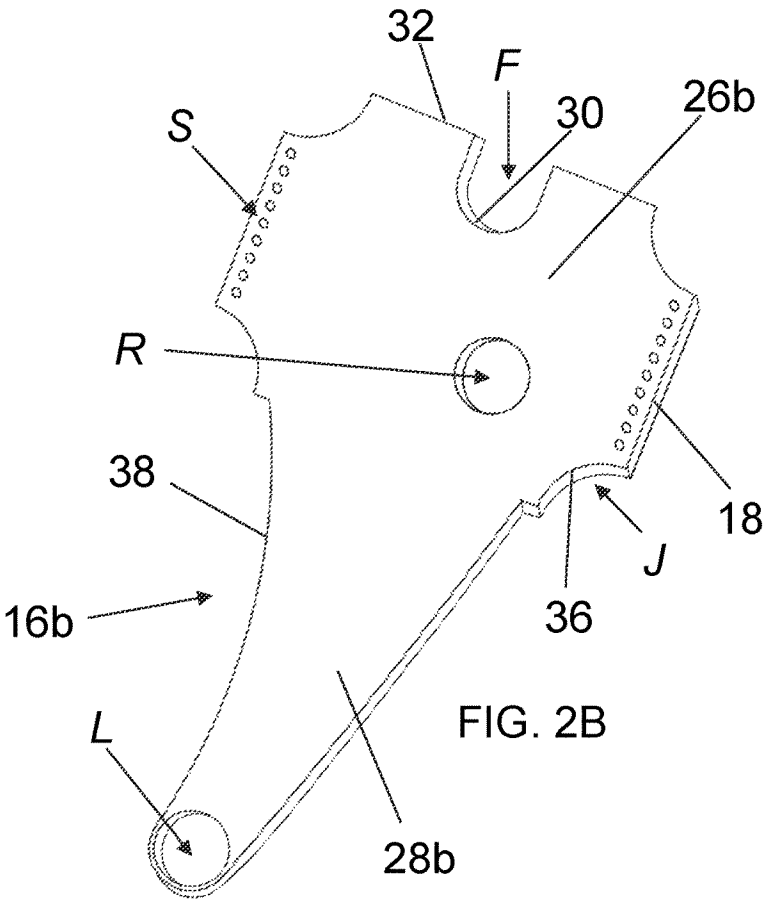
FIG. 2B is a perspective view of an embodiment of a second sheet of pliable, durable material formed in a pattern comprising a panel and a flap in the embodiment of the dual lock wallet of FIG. 1.
Figure 2A:
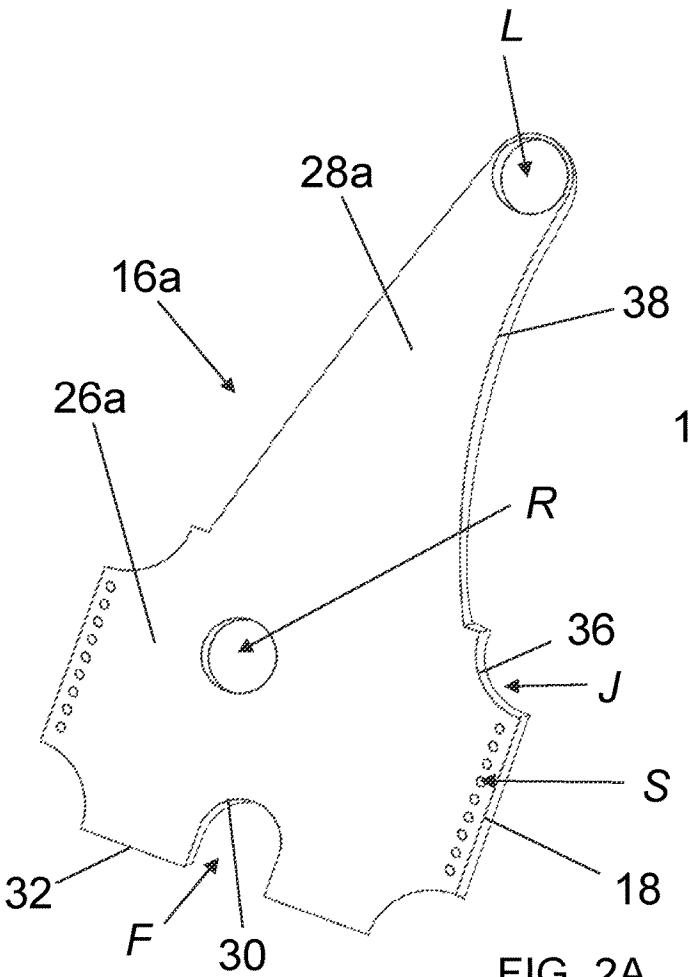
FIG. 2A is a perspective view of an embodiment of a first sheet of pliable, durable material formed in a pattern comprising a panel and a flap in the embodiment of the dual lock wallet of FIG. 1.

As shown in FIGS. 2A and 2B, the first and second leather or fabric sheets 16*a* and 16*b* are cut into a pattern to form a panel 26*a* and 26*b* and a flap 28*a* and 28*b* with the flap 28*a* and 28*b* extending from each panel 26*a* and 26*b*. The sheets 16*a* and 16*b* are fairly thin to be pliable and fold and are durable to resist wear after long periods of use. In some embodiments, a receiver opening R for the receiver portion 24 of the locking fixture 20 is cut through a portion of each panel 26*a* and 26*b* and a lock opening L for the lock portion 22 of the locking fixture 20 is cut through each flap 28*a* and 28*b*. In other embodiments the lock portion 22 and the receiver portion 24 of the locking fixture 20 may be sewn, glued or stapled to each sheet 16*a* and 16*b*, so there is not a requirement for a receiver opening R or lock opening L through the sheets 16*a* and 16*b*. A finger slot F may be formed by cutting out a semicircular shape 30 along the edge 32 of each panel 26*a* and 26*b* for easier removal of the contents within the dual lock wallet 10. A series of seam holes S may also be provided along the side edge 18 of each panel 26*a* and 26*b* to provide for the panels 26*a* and 26*b* to be sewn together. Cutouts J may also be formed in one or more corners of each panel 26*a* and 26*b* to form a curved edge 36 to provide for viewing of the contents within the dual lock wallet 10 when the locking fixtures 20 are secured. The flaps 28*a* and 28*b* of each sheet 16*a* and 16*b* may be formed in a lengthened triangular shape. In some embodiments the triangular shape may have a sloping curvature along one edge 38 to reduce the overall thickness of the dual lock wallet 10 and make the dual lock wallet 10 thinner and easier to insert into a pants pocket.

Figures 3A, 3B, 3C, 3D:
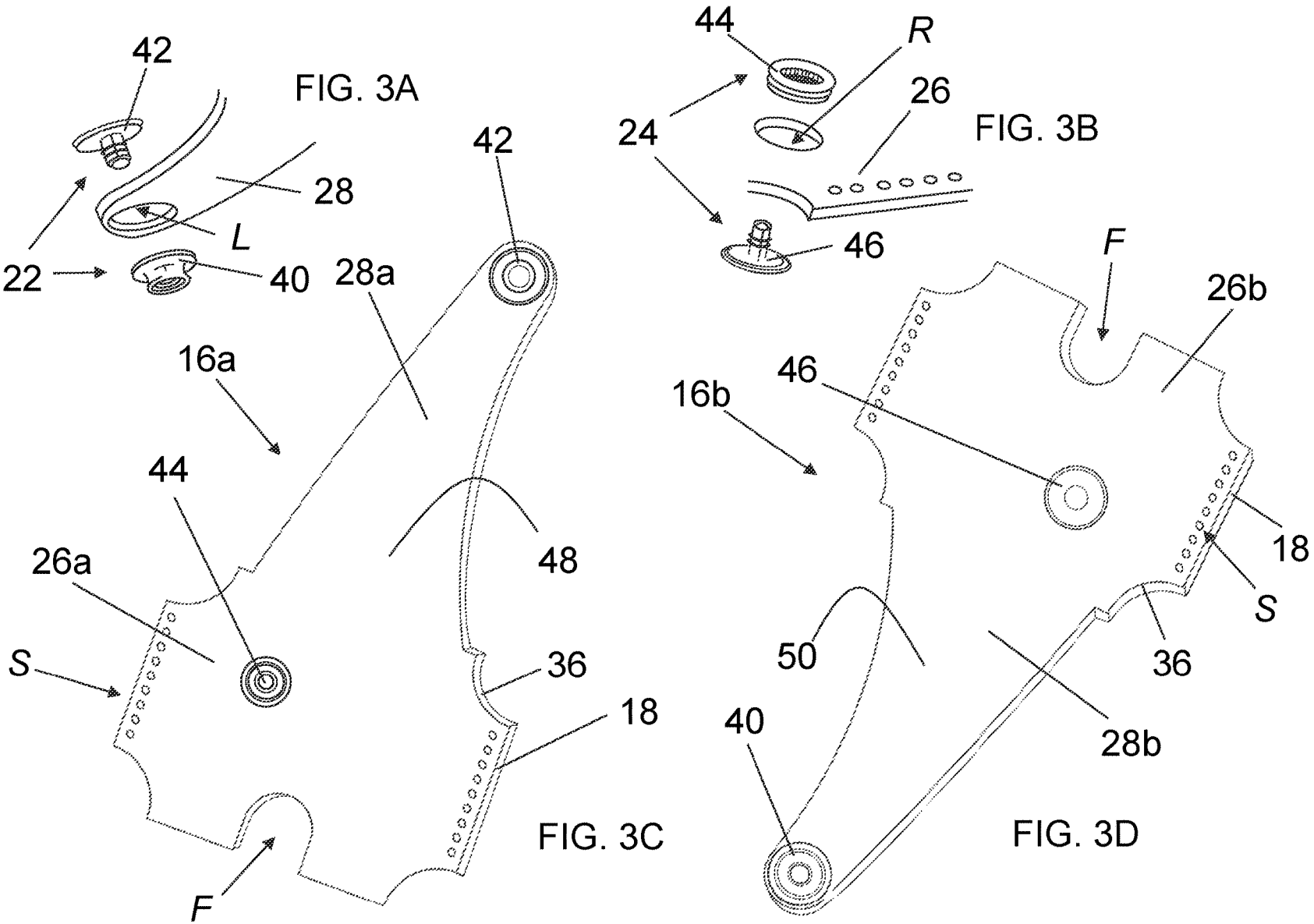
FIG. 3A is an exploded view of an embodiment of an assembly of a snap and an eyelet to be inserted through a flap of a sheet in the embodiment of the dual lock wallet of FIG. 1.
FIG. 3B is an exploded view of an embodiment of the assembly of a socket and a cap to be inserted through a panel of a sheet in the embodiment of the dual lock wallet of FIG. 1.
FIG. 3C is a perspective view of an embodiment of a first sheet of pliable, durable material formed in a pattern with a snap as the lock portion of a first locking fixture affixed to the flap and a socket as a receiver portion of a second locking fixture affixed to the panel in the embodiment of the dual lock wallet of FIG. 1.
FIG. 3D is a perspective view of an embodiment of a second sheet of pliable, durable material formed in a pattern with a snap as the lock portion of a first locking fixture affixed to the flap and a socket as the receiver portion of a second locking fixture affixed to the panel in the embodiment of the dual lock wallet of FIG. 1.
Figure 4A:
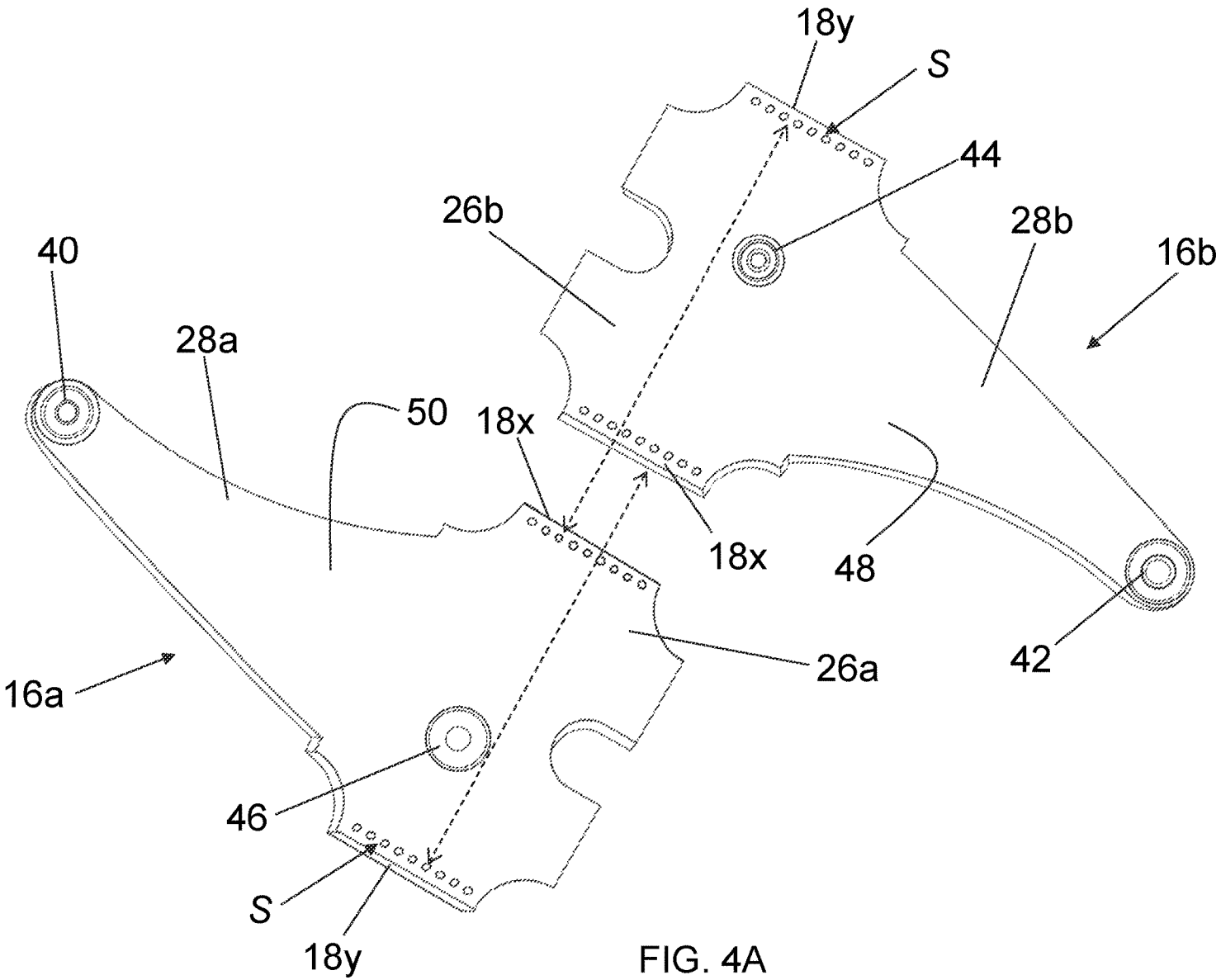
FIG. 4A is a perspective view of an embodiment of the assembly illustrating the attachment of the first and second sheets in the embodiment of the dual lock wallet of FIG. 1.

As shown in FIG. 3A, in an embodiment of the dual lock wallet 10, the lock portion 22 of the locking fixture 20 may be a snap 40 that is attached to the flap 28 by inserting an eyelet 42 through the lock opening L and securing the eyelet 42 using a compression fit to the snap 40. As shown in FIG. 3B, the receiver portion 24 of the locking fixture 20 that mates with the snap 40 is a socket 44 that is installed within the receiver opening R and secured to the panel 26 of the sheet 16 with a cap 46. In order to have the orientation of the locking fixtures 20 provide for securing the first and second sheets 16*a* and 16*b* along each end, the eyelet 42 and the socket 44 are inserted into and through the outer surface 48 of the sheet 16, as shown in FIG. 3C. The cap 46 and snap 44 are positioned and secured to the inner surface 50 of the sheet 16, as shown in FIG. 3D. Using this orientation, as shown in FIG. 4A, a first sheet 16*a* is placed with its inner surface 50 facing up and a second sheet 16*b* is placed with its outer surface 48 facing up. The edge 18*x* of the panel 26*a* of the first sheet 16*a* is aligned with the edge 18*y* of the panel 26*b* of the second sheet 16*b* and the edge 18*y* of the panel 26*a* of the first sheet 16*a* is aligned with the edge 18*x* of the panel 26*b* of the second sheet 16*b* so that the seam holes S along the edges 18*x* and 18*y* line up.

Figure 4B:
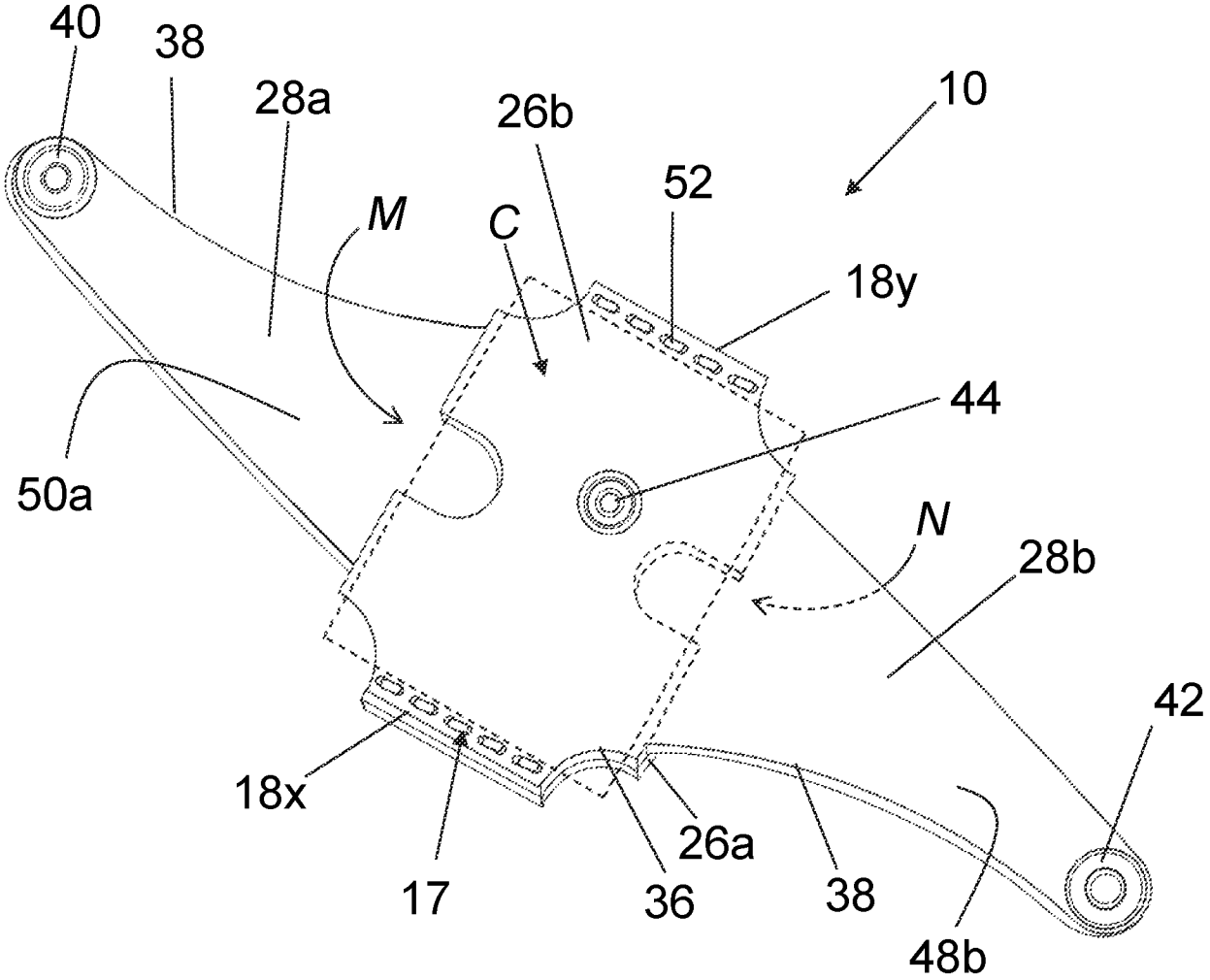
FIG. 4B is a perspective view of an embodiment of the attachment of the first and second sheets along the outer edges of each of the panels in the embodiment of the dual lock wallet of FIG. 1.
Figure 4C:
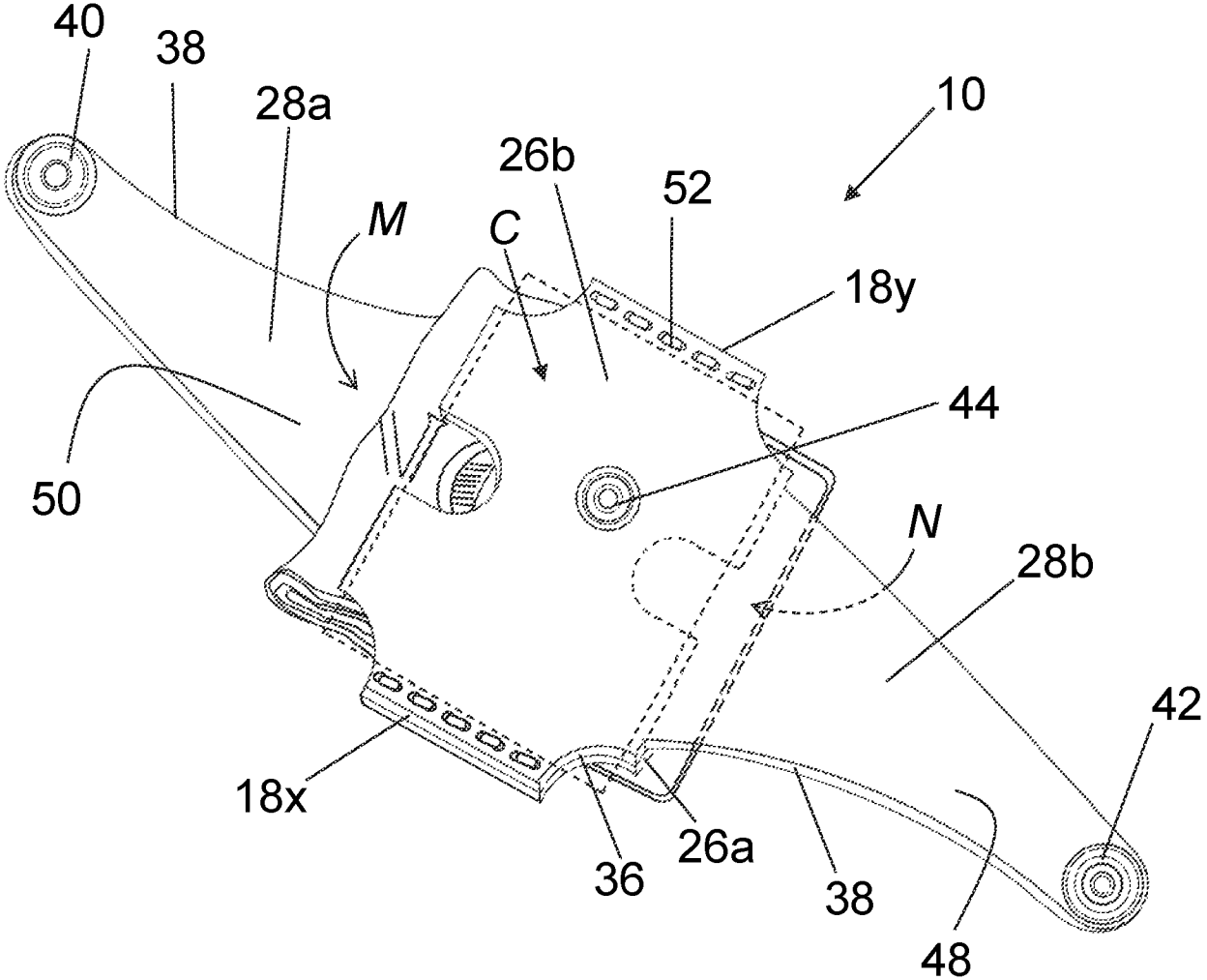
FIG. 4C is a perspective view of the embodiment of the dual lock wallet of FIG. 1 with contents of paper money and credit cards, the dual lock wallet in an open position.

As shown in FIG. 4B, twine or thread 52 is woven through the seam holes S to form a seam 17 and the panels 26*a* and 26*b* of the two sheets 16*a* and 16*b* are attached together. Once attached, a slot is formed between the overlaid panels 26*a* and 26*b* with an access point M at one end of the slot accessible from the inner surface 50*a* along the flap 28*a* of first sheet 16*a*. A second access point N at the other end of the slot is accessible from the opposing side along the inner surface 50*b* of the second sheet 16*b*. As shown in FIG. 4C, the slot forms a holding area or compartment C shown for illustrative purposes surrounded with a dotted line between the two panels 26*a* and 26*b*. The two access points M and Nat each end of the compartment C provide as an example for paper money 12 to be inserted through the slot and into the compartment C from one access point M and credit cards 14 from the other access point N to be inserted through the slot into the compartment C from beneath the flap 28*b* as shown.

Figure 5A:
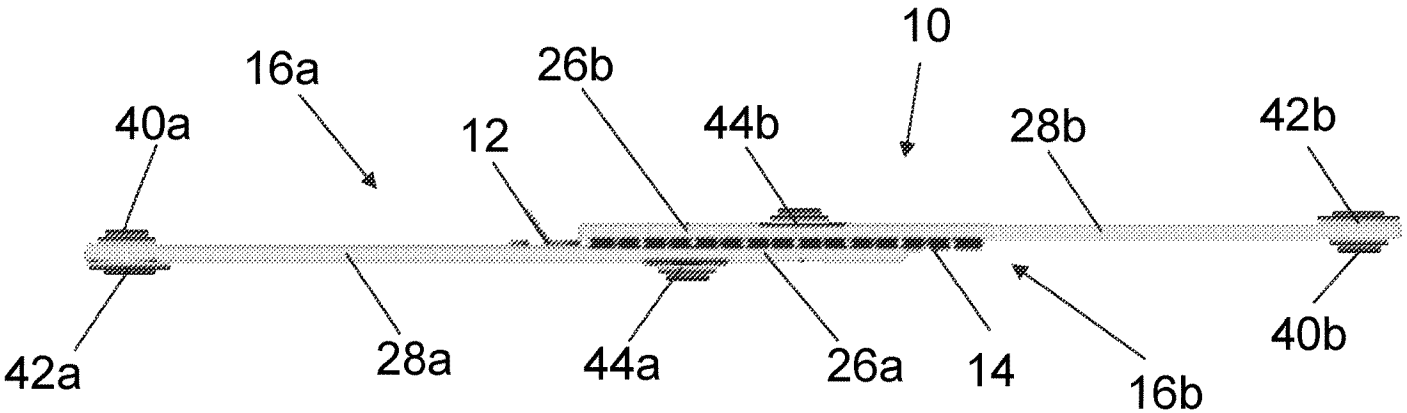
FIG. 5A is a side view of the embodiment of the dual lock wallet of FIG. 1 with contents of paper money and credit cards, the dual lock wallet in an open position.
Figure 5B:
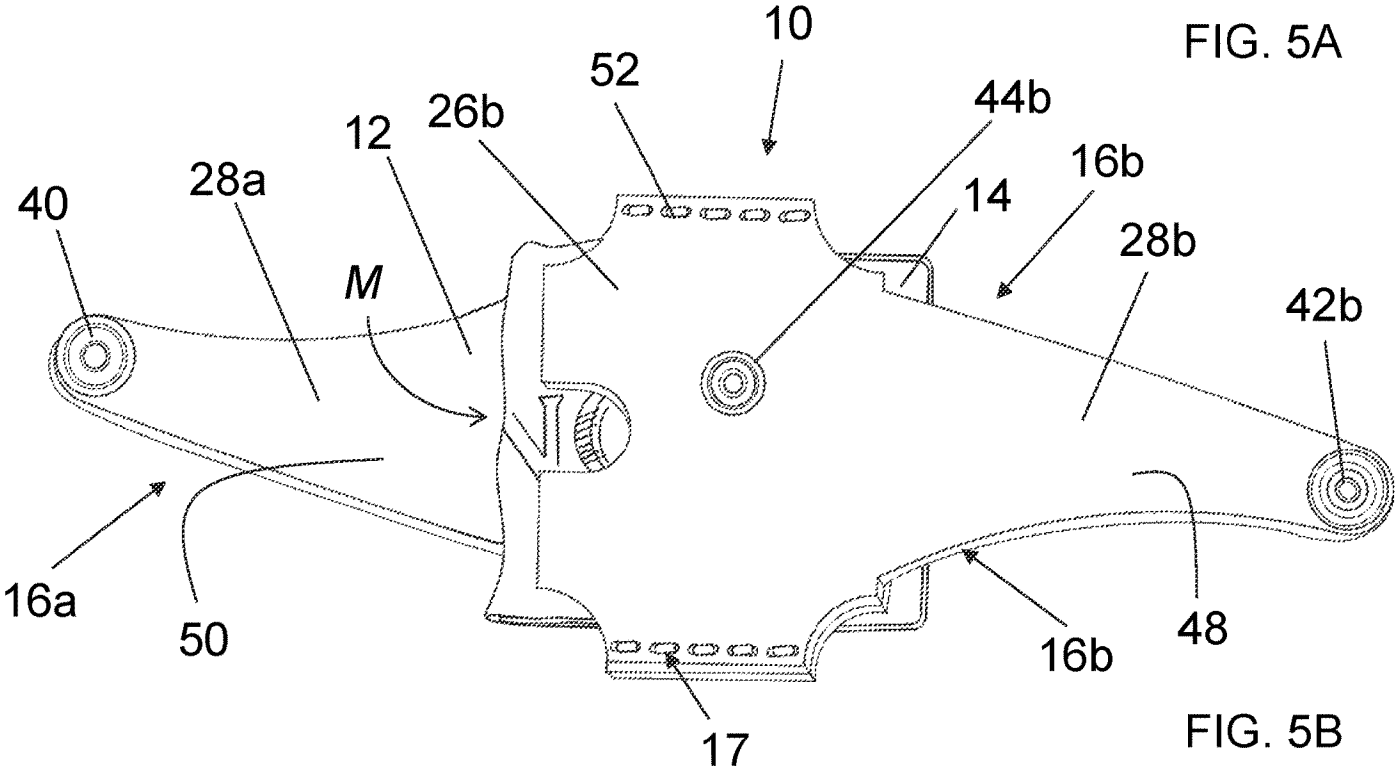
FIG. 5B is a top view of the embodiment of the dual lock wallet of FIG. 1 with contents of paper money and credit cards, the dual lock wallet in an open position.
Figure 5C:
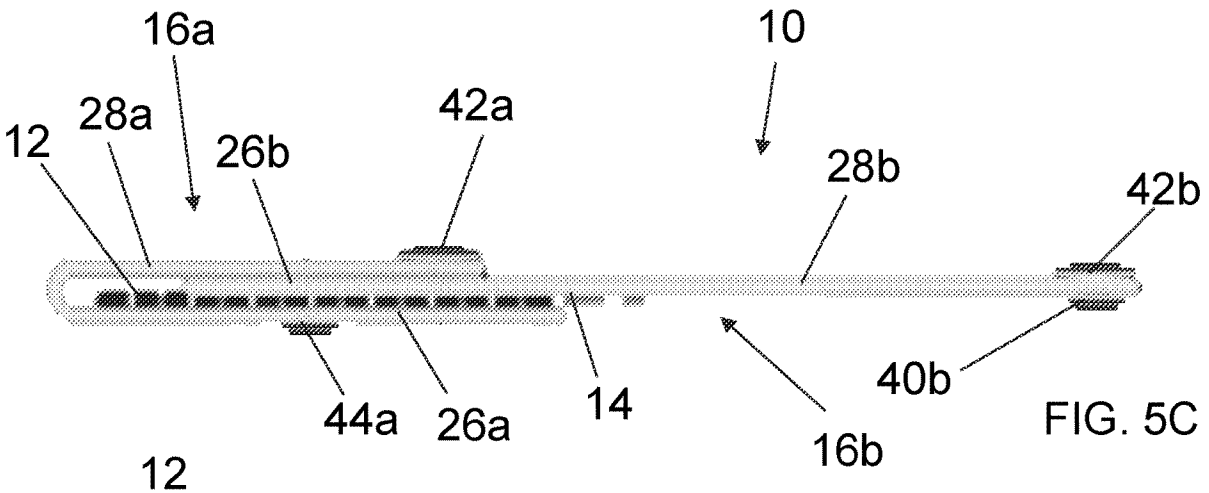
FIG. 5C is a side view of the embodiment of the dual lock wallet of FIG. 1 with contents of paper money and credit cards with one flap of the dual lock wallet closed securing one access point.
Figure 5D:
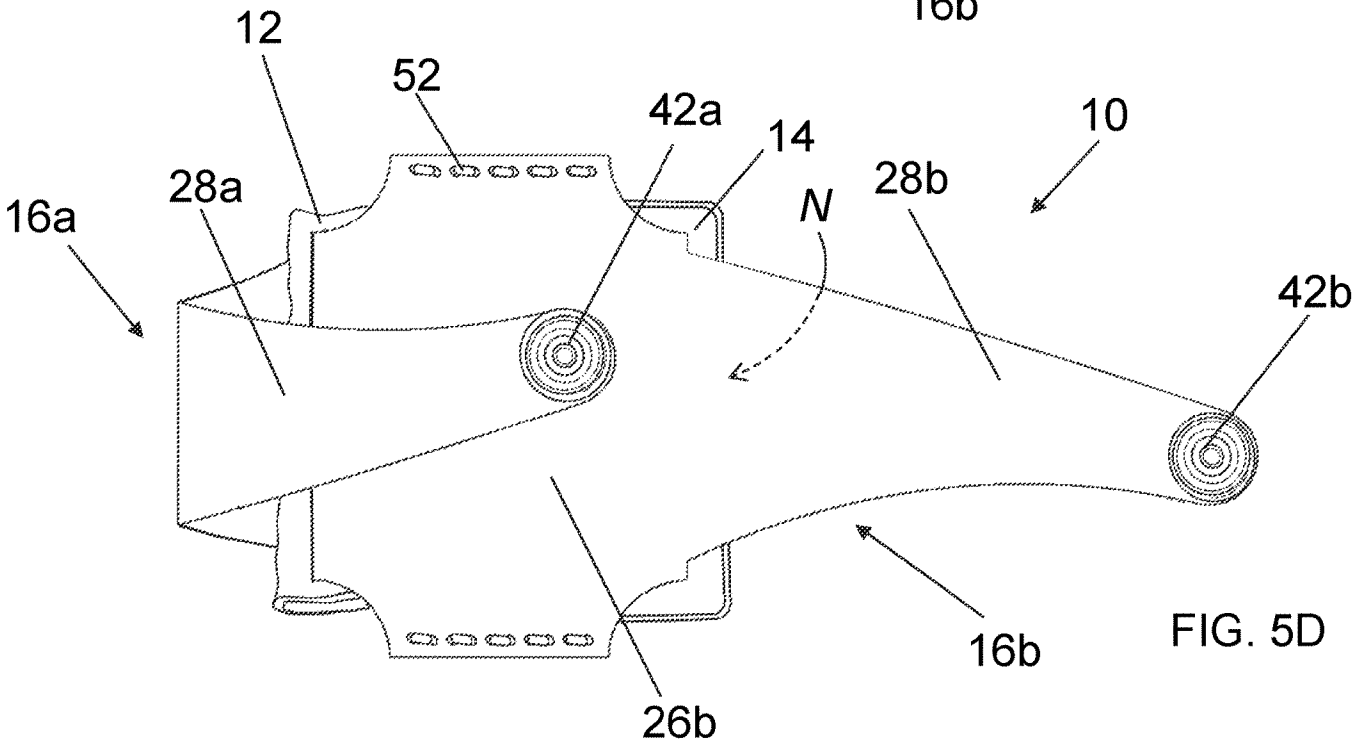
FIG. 5D is a top view of the embodiment of the dual lock wallet of FIG. 1 with contents of paper money and credit cards with one flap of the dual lock wallet closed securing one access point.

FIG. 5A shows a side elevation view of the dual lock wallet 10 of the present invention. The first snap 40*a* and eyelet 42*a* are shown at the end of the flap 28*a* and the socket 44*a* is within the panel 26*a* of the first sheet 16*a*. The second snap 40*b* and second eyelet 42*b* are shown at the end of the flap 28*b* and the socket 44*b* is within the panel 26*b* of the second sheet 16*b*. The two panels 26*a* and 26*b* are held together by the threads 52 that form the seams 17 and paper money 12 and credit cards 14 are shown inserted the between the two panels 26*a* and 26*b*. In a rotated view in FIG. 5B, showing the second sheet 16*b* on the top, the first flap 28*a* may be folded over the second sheet panel 26*b* and be aligned with the socket 44*b* to affix the flap 28*a* to panel 26*b* to secure the contents inserted within the access point M within the dual lock wallet 10, as shown in FIG. 5C. Using the snap 40*a* from the first flap 28*a* and socket 44*b* within the panel 26*b* of the second sheet 16*b* and compressing on the eyelet 42*a* of the first flap 28*a*, as shown in FIG. 5D, a tight frictional fit is formed with the snap 40*a* being securely held in the socket 44*b*.

Figure 5E:
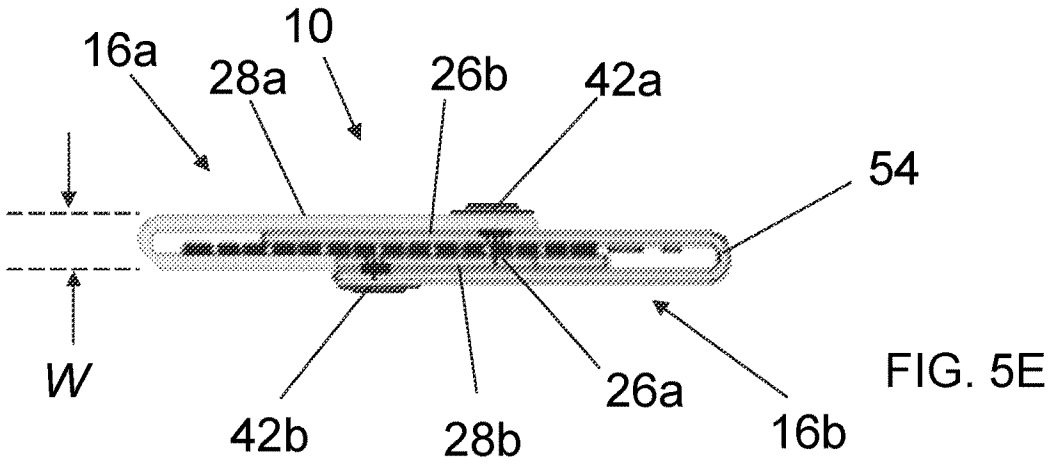
FIG. 5E is a side view of the embodiment of the dual lock wallet of FIG. 1 with contents of paper money and credit cards, the dual lock wallet in a closed position securing both access points.
Figure 5F:
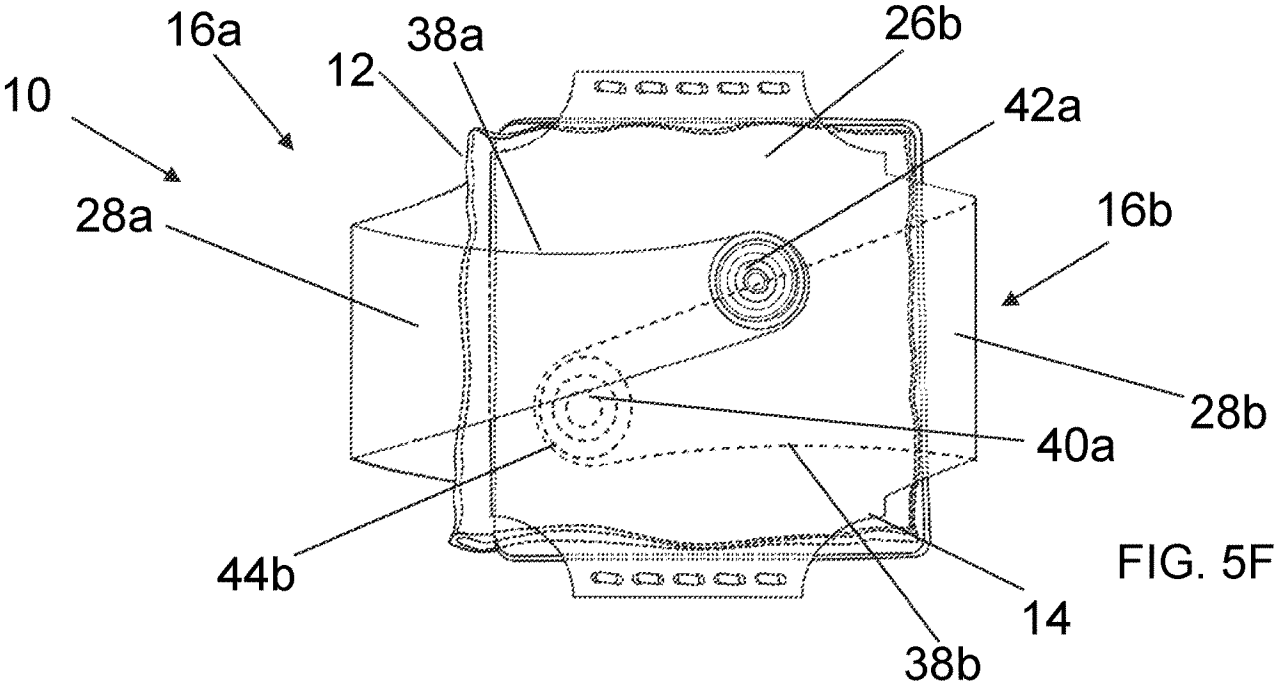
FIG. 5F is a top view of the embodiment of the dual lock wallet of FIG. 1 with contents of paper money and credit cards, the dual lock wallet in a closed position securing both access points.

The flap 28*b* of the second sheet 16*b* can then be folded over the panel 26*a* of the first sheet 16*a* and the eyelet 42*b* can be compressed to have the snap 40*b* be forced into the socket 44*a* to secure the contents inserted through the access point N. Once closed and secured on each end, the width W of the dual lock wallet 10 is fairly thin, as shown in FIG. 5E, because of the thin wall thickness of the leather or fabric of each of the sheets 16*a* and 16*b*, and because of minimal overlap of the flaps 28*a* and 28*b* of the sheets 16*a* and 16*b* due to each of the flaps 28*a* and 28*b* being formed as a lengthened triangular shape. As shown in FIG. 5F, by also including the sloping curvature along one edge 38*a* and 38*b*, the amount of material that overlaps the panel 26*b* and 26*a*, respectfully, is greatly reduced. Using fabric or leather further provides for the folds 54 to stretch and expand as needed to accommodate more cash 12 or credit cards 14 within the dual lock wallet 10. The snap 40 and socket 44 configuration is also not easily opened and requires force to pull the snap 40 out of the socket 44 providing more of a deterrent than a billfold type of wallet of the prior art that can be opened by simply pulling apart the overlapping sheets forming the pocket.

Figure 6A:
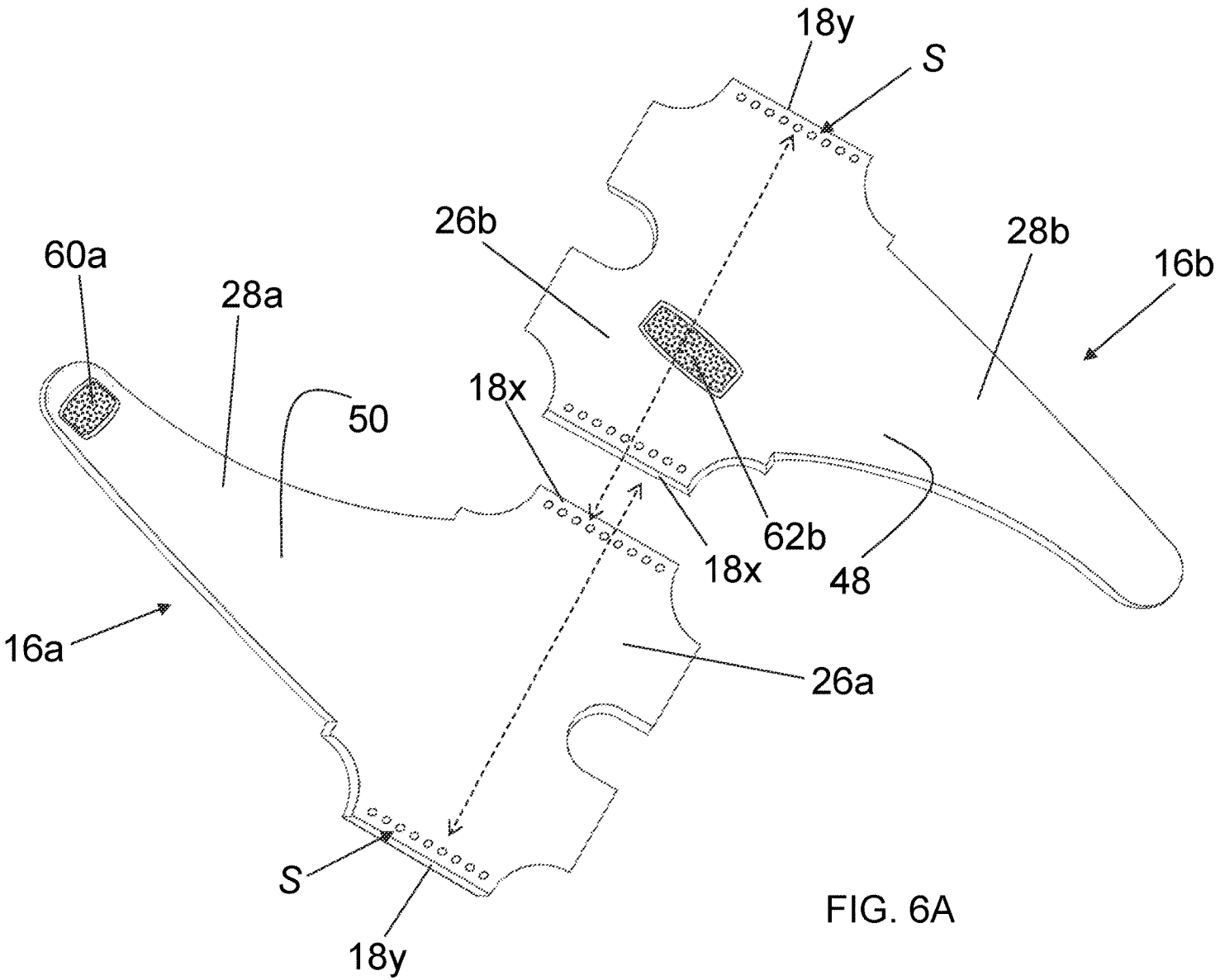
FIG. 6A is a perspective view of a further embodiment of the present invention having a hook and loop fastener for the locking fixtures illustrating the assembly of the first and second sheets.

In a further embodiment, as shown in FIG. 6A, the snap 40 and socket 44 of the locking fixture 20 is replaced with hook and loop fasteners, with a hook fastener 60*a* affixed on the inner surface 50 at the end of a flap 28*a* of a first sheet 16*a* and a loop fastener 62*b* affixed to the outer surface 48 of a panel 26*b* of a second sheet 16*b*. A second loop fastener 62*a* (not shown) is affixed to the outer surface 48 of a panel 26*a* of the first sheet 16*a* and a second hook fastener 60*b* (not shown) is affixed to the inner surface 50 at the end of a flap 28*b* of a second sheet 16*b*. An alternative configuration of the placement of the hook and/or loop fasteners is within the scope of the present invention.

Figure 6B:
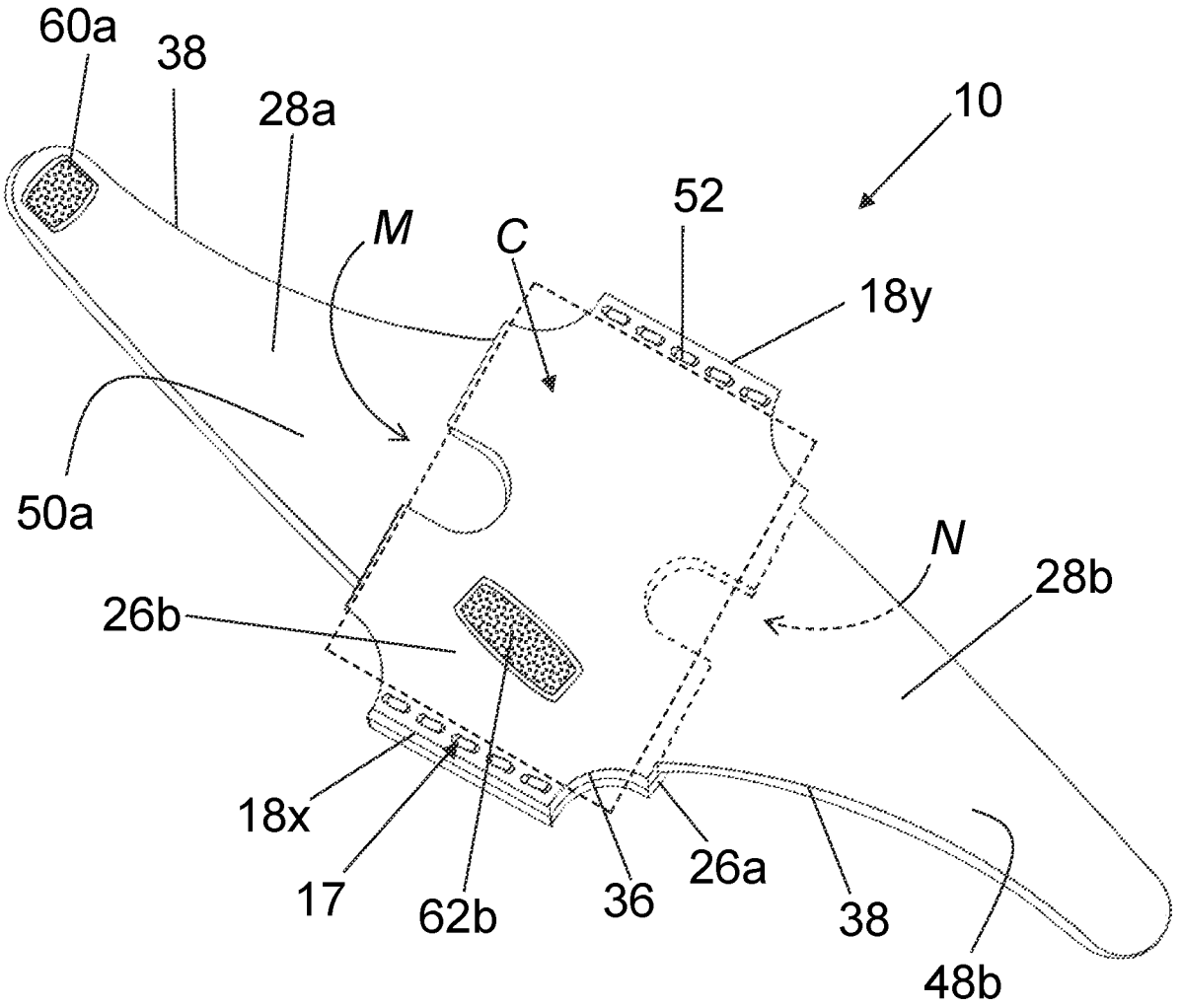
FIG. 6B is a perspective view of the further embodiment of the dual lock wallet of FIG. 6A illustrating the attachment of the first and second sheets along the outer edges of each of the panels.
Figure 6C:
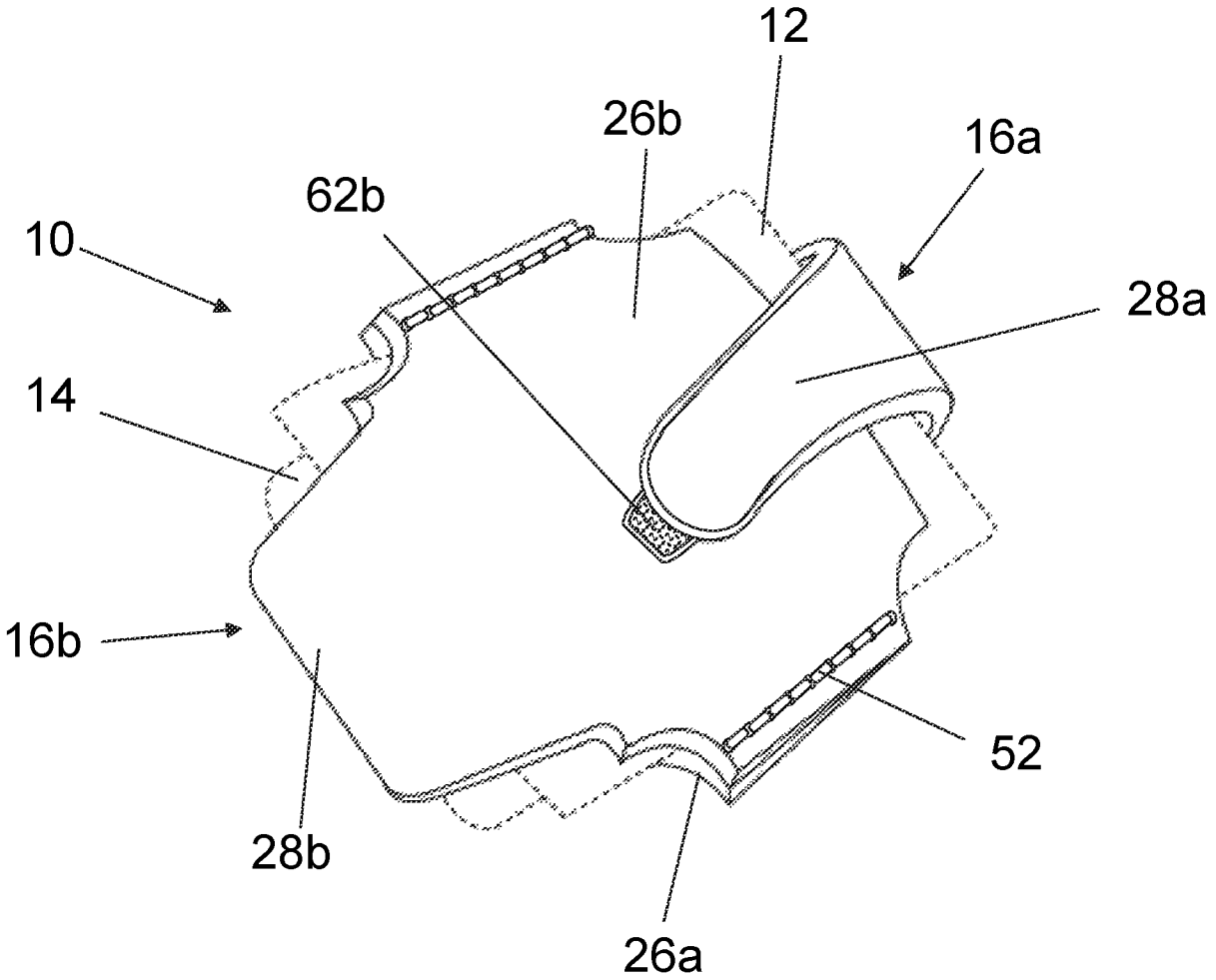
FIG. 6C is a perspective view of the further embodiment of the dual lock wallet of FIG. 6A with contents of paper money and credit cards and the dual lock wallet in a closed position securing both access points.

The further embodiment of the dual lock wallet 10 is assembled as in other embodiments with a first sheet 16*a* being placed with its inner surface 50 facing up and a second sheet 16*b* being placed with its outer surface 48 facing up. The edge 18*x* of the panel 26*a* of the first sheet 16*a* is aligned with the edge 18*y* of the panel 26*b* of the second sheet 16*b* and the edge 18*y* of the panel 26*a* of the first sheet 16*a* is aligned with the edge 18*x* of the panel 26*b* of the second sheet 16*b* so that the seam holes S along the edges 18*x* and 18*y* line up. As shown in FIG. 6B, twine or thread 52 is woven through the seam holes S to form a seam 17 and the panels 26*a* and 26*b* of the two sheets 16*a* and 16*b* are attached together. Once attached, the slot between the overlaid panels 26*a* and 26*b* forms a compartment C shown for illustrative purposes surrounded by a dotted line with an access point M at one end of the slot accessible from the inner surface 50*a* along the flap 28*a* of first sheet 16*a*. A second access point N at the other end of the slot forming the compartment C is accessible from the opposing side along the inner surface 50*b* of the second sheet 16*b*. The two access points M and N at each end of the slot provide for example for paper money 12 to be inserted through the slot into the compartment C from one access point Mand credit cards 14 to be inserted into the slot from beneath the flap 28*b* as shown into the other access point N. The contents inserted within the further embodiment of the dual lock wallet 10 is secured by folding the first flap 28*a* of the first sheet 16*a* over the panel 26*b* of the second sheet 16*b* and aligning the hook fastener 60*a* with the loop fastener 62*b* and pressing on the outer surface 48 of the first flap 28*a* to have the hook fastener 60*a* adhere to the loop fastener 62*b*. By then folding the second flap 28*b* over the first panel 26*a* and aligning the hook fastener 60*b* with the loop fastener 62*a* and pressing along the outer surface 48, the contents of the dual lock wallet is secured at both access points M and N, as shown in FIG. 6C.

Figure 7A:
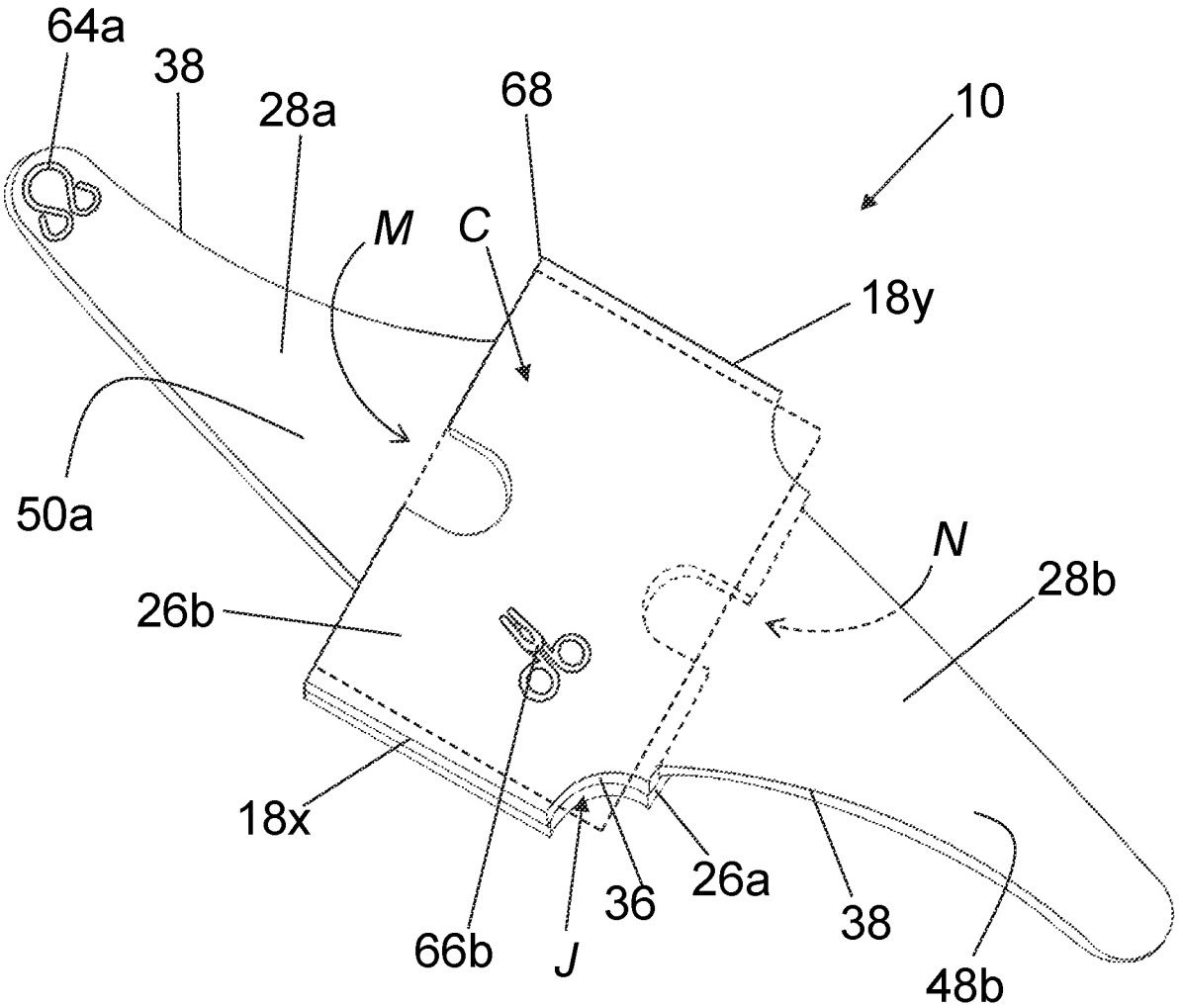
FIG. 7A is a perspective view of a still further embodiment of the present invention having a hook and eye fastener for the locking fixtures illustrating the attachment of the first and second sheets.

In a still further embodiment as shown in FIG. 7A, the locking fixture 20 is a clasp formed from an eye fastener 64*a* affixed on the inner surface 50 at the end of a flap 28*a* of a first sheet 16*a* and a hook fastener 66*b* affixed to the outer surface 48 of a panel 26*b* of a second sheet 16*b*. A second hook fastener 66*a* (not shown) is affixed to the outer surface 48 of a panel 26*a* of the first sheet 16*a* and a second eye fastener 64*b* (not shown) is affixed to the inner surface 50 at the end of a flap 28*b* of a second sheet 16*b*. An alternative configuration of the placement of the hook and/or eye fasteners is within the scope of the present invention. This still further embodiment of the dual lock wallet 10 is assembled as in other embodiments with a first sheet 16*a* being placed with its inner surface 50 facing up and a second sheet 16*b* being placed with its outer surface 48 facing up. The edge 18*x* of the panel 26*a* of the first sheet 16*a* is aligned with the edge 18*y* of the panel 26*b* of the second sheet 16*b* and the edge 18*y* of the panel 26*a* of the first sheet 16*a* is aligned with the edge 18*x* of the panel 26*b* of the second sheet 16*b* so that the edges 18*x* and 18*y* line up. The two sheets 16*a* and 16*b* in some embodiments are attached together using adhesive applied only along the surface near the edges 18*x* of a first sheet 16*a* adhered to 18*y* of the second sheet 16*b* and 18*x* of the second sheet 16*b* adhered to 18*y* of the second sheet 18*x* instead of using thread meaning that the panels 26*a* and 26*b* may be formed without seam holes S. In some embodiments, the dual lock wallet 10 may be formed with cutouts J with a curved edge 36 in only, for example, two of the four corners 68. The cutouts J provide visibility to the contents of the dual lock wallet 10.

Figure 7B:
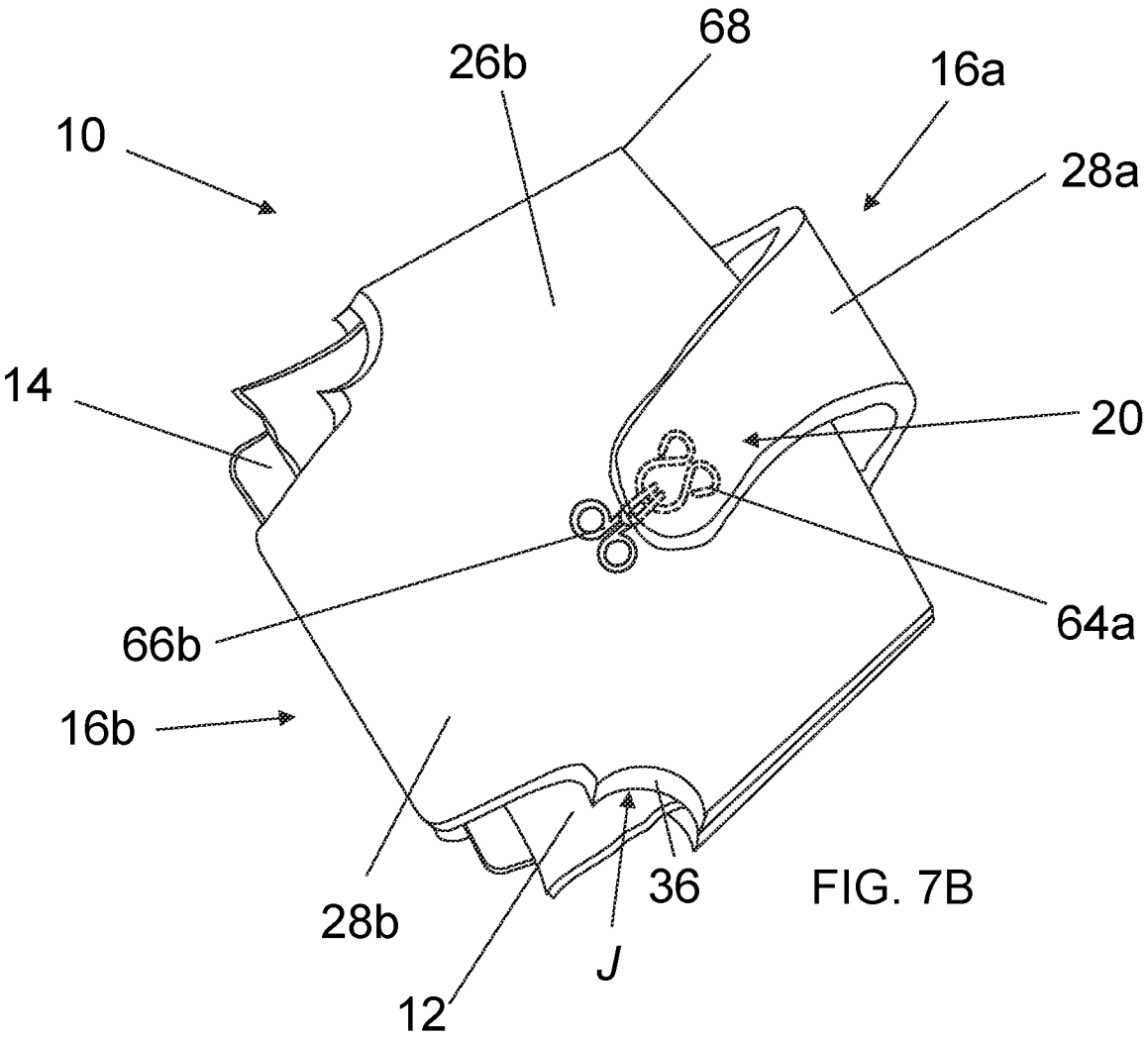
FIG. 7B is a perspective view of the still further embodiment of the dual lock wallet of FIG. 7A with contents of paper money and credit cards and the dual lock wallet in a closed position securing both access points.

Similarly, to other embodiments, once the panels 26*a* and 26*b* are adhered together, a slot forms a compartment C between the overlaid panels 26*a* and 26*b* with an access point M at one end of the compartment C accessible from the inner surface 50*a* along the flap 28*a* of first sheet 16*a*. A second access point N at the other end of the compartment C is accessible from the opposing side along the inner surface 50*b* of the second sheet 16*b*. The two access points M and N at each end of the compartment C provide for example for paper money 12 to be inserted into the slot from one access point M and credit cards 14 to be inserted into the slot from beneath the flap 28*b* as shown into the other access point N. The contents inserted within the still further embodiment of the dual lock wallet 10 is secured by folding the first flap 28*a* of the first sheet 16*a* over the panel 26*b* of the second sheet 16*b* and aligning the eye fastener 64*a* with the hook fastener 66*b* to have the hook fastener 66*b* be engaged with the eye fastener 64*a*, preventing the flap 28*a* from being pulled away from the panel 26*b*. By then folding the second flap 28*b* over the first panel 26*a* and aligning the eye fastener 64*b* with the hook fastener 66*a* and engaging the hook fastener 66*a* with the eye fastener 64*b*, the contents of the dual lock wallet 10 is secured at both access points M and N, as shown in FIG. 7B.

Although specific embodiments of the invention have been disclosed herein in detail, it is to be understood that this is for purposes of illustration. This disclosure is not to be construed as limiting the scope of the invention, since the described embodiments may be changed in detail as will become apparent to those skilled in the art in order to adapt the invention to particular applications, without departing from the scope of the following claims and equivalents of the claimed elements.

What is claimed is:

1. A wallet comprising:

a first sheet formed as a first panel and a first flap, the first flap extending from the first panel;

a first locking fixture having a first receiver affixed to the first panel and a first lock affixed to the first flap;

a second sheet formed as a second panel and a second flap, the second flap extending from the second panel;

a second locking fixture having a second receiver affixed to the second panel and second lock affixed to the second flap; and wherein the first receiver configured to receive the second lock to secure the first flap to the second panel thereby configured to secure a first access point of a wallet; and wherein the second receiver configured to receive the first lock to secure the second flap to the first panel thereby configured to secure a second access point of the wallet.

2. The wallet of claim 1 wherein the first and second sheets are of a pliable, durable material such as leather or fabric.

3. The wallet of claim 1 wherein the first sheet is configured to be aligned over the second sheet and the first and second sheets are configured to be attached together along a first edge seam and a second edge seam forming a compartment having the first access point on one end and the second access point on the other end, the compartment configured to hold money, credit cards, identification, or other plastic currency.

4. The wallet of claim 1 wherein the first and second receivers are first and second sockets and the first and second locks are snaps configured to be attached to the first and second socket receivers.

5. The wallet of claim 1 wherein the first and second receivers are hook fasteners and the first and second locks are loop fasteners configured to be attached to the first and second hook receivers.

6. The wallet of claim 1 wherein the first and second receivers are first and second fasteners and the first and second locks are clips configured to be attached to the first and second fastener receivers.

7. The wallet of claim 1 wherein the first and second receivers are first and second hooks and the first and second locks are eye fasteners configured to be attached to the first and second hook receivers.

8. The wallet of claim 1 wherein the first and second panels comprise cutouts in at least one of four corners, the first and second panels configured to have contents within the wallet be viewable at the points where a panel has the at least one cutout.

9. The wallet of claim 1 wherein the first and second panels comprise a finger slot configured to assist in removing contents from within the wallet.

10. The wallet of claim 1 wherein the first and second flaps comprise a triangular shape, the triangular shape configured to reduce the thickness of the wallet.

11. The wallet of claim 1 wherein the first and second flaps comprise a triangular shape and a curvature forming the edges of the triangle, the curved triangular shape configured to reduce the thickness of the wallet.

* * * * *